US007073919B1

(12) United States Patent
Masina

(10) Patent No.: US 7,073,919 B1
(45) Date of Patent: Jul. 11, 2006

(54) LIGHT ASSEMBLY WITH LAMPSHADE

(76) Inventor: Ante Masina, 4785 W. Linda Ct., Chandler, AZ (US) 85226

( * ) Notice: Subject to any disclaimer, the term of this patent is extended or adjusted under 35 U.S.C. 154(b) by 0 days.

(21) Appl. No.: 11/132,128

(22) Filed: May 18, 2005

(51) Int. Cl.
*F21V 1/00* (2006.01)

(52) U.S. Cl. ..... 362/153.1; 362/355; 362/356

(58) Field of Classification Search ..... 362/153.1, 362/153, 183, 351, 355, 356
See application file for complete search history.

(56) References Cited

U.S. PATENT DOCUMENTS

| | | | | |
|---|---|---|---|---|
| 3,805,055 | A | 4/1974 | Cassey | |
| 4,268,896 | A | 5/1981 | Mann | |
| 5,274,537 | A | 12/1993 | Altman | |
| 5,384,694 | A * | 1/1995 | Yang | 362/298 |
| 5,406,466 | A | 4/1995 | Stokes | |
| 5,526,243 | A | 6/1996 | Masters | |
| 6,000,820 | A | 12/1999 | Murray | |
| 6,575,591 | B1 | 6/2003 | De Lany | |
| 6,746,136 | B1 | 6/2004 | Fung | |
| 6,874,905 | B1 * | 4/2005 | Beadle | 362/153.1 |

* cited by examiner

*Primary Examiner*—Laura Tso
(74) *Attorney, Agent, or Firm*—Parsons & Goltry; Michael W. Goltry; Robert A. Parsons

(57) ABSTRACT

A light assembly includes a light fixture having a lower extremity affixed to the upper end of the elongate support and an opposing upper extremity, a light between the upper and lower extremities, and a parametric light fixture shade disposed at the upper extremity overlying the light. A lampshade includes a parametric flange having a continuous inner edge bounding an opening and an opposing continuous outer edge, a continuous outer face and an opposing continuous inner face. A continuous sidewall depends from the parametric flange and has a continuous upper edge affixed to the continuous outer edge of the parametric flange and an opposing continuous lower edge, a continuous outer face and an opposing continuous inner face. The continuous inner face of the parametric flange of the lampshade rests against the parametric light fixture shade. The continuous sidewall of the lampshade projects downwardly from the parametric light fixture shade encircling the light fixture.

12 Claims, 6 Drawing Sheets

FIGURE 1
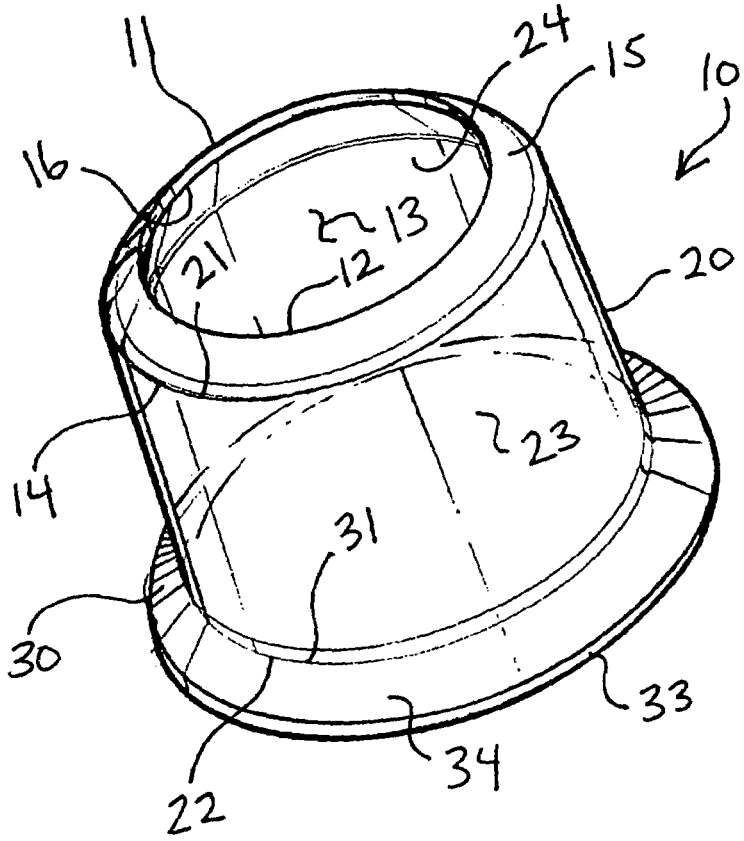
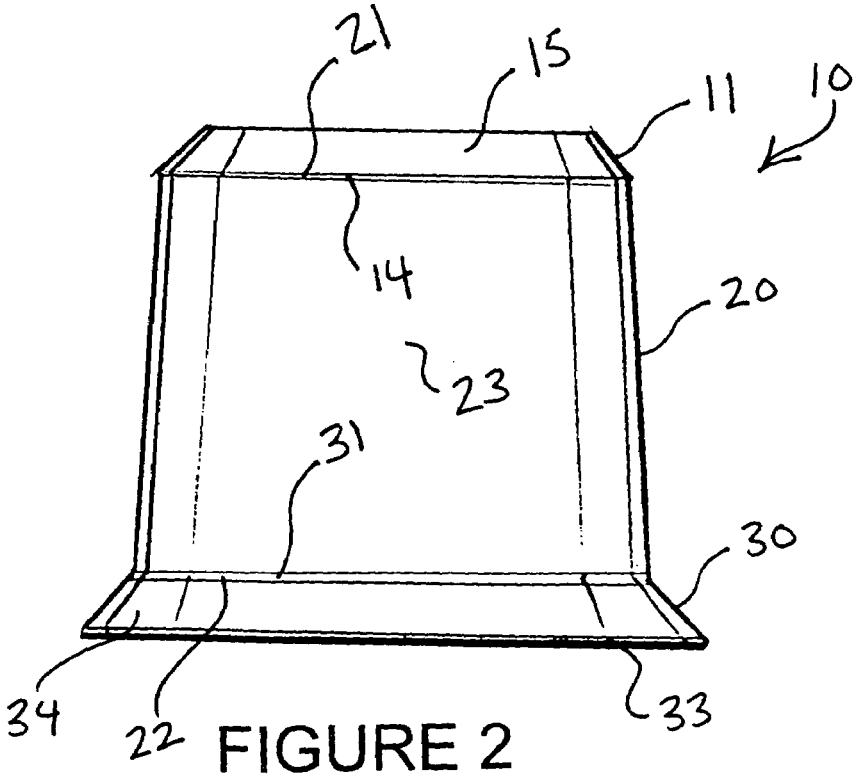
FIGURE 2

LIGHT ASSEMBLY WITH LAMPSHADE

FIELD OF THE INVENTION

The present invention relates to lighting and, more particularly, to landscape light installations.

BACKGROUND OF THE INVENTION

Outdoor landscape and edge lighting has becoming increasingly popular through recent years. In an effort to make installing outdoor lighting more simple and efficient, many varieties of outdoor lighting constitute self-contained lighting units, which are powered by photovoltaic cells incorporated therewith. Still, existing outdoor light fixtures, especially those having solar power capabilities, are often either not entirely aesthetically pleasing or do not embody the required style and grace. Given these and other deficiencies in the art of solar powered outdoor lighting units and also those powered by conventional electrical wiring, the need for certain new and useful improvements is evident.

SUMMARY OF THE INVENTION

According to the invention, a light assembly an elongate support having an upper end and an opposing lower end, and a light fixture. The light fixture has a lower extremity affixed to the upper end of the elongate support and an opposing upper extremity, a light between the upper and lower extremities, and a parametric light fixture shade disposed at the upper extremity and overlying the light. The parametric light fixture shade includes a continuous inner edge and an opposing continuous outer edge, and an upper parametric face between the continuous inner and outer edges. Further included is a lampshade, which includes a parametric flange having a continuous inner edge bounding an opening and an opposing continuous outer edge, a continuous outer face, an opposing continuous inner face, and a continuous sidewall depending from the parametric flange and having a continuous upper edge affixed to the continuous outer edge of the parametric flange and an opposing continuous lower edge, a continuous outer face and an opposing continuous inner face. The continuous inner face of the parametric flange of the lampshade rests against the upper parametric face of the parametric light fixture shade, and the continuous inner edge of the parametric flanged is positioned between continuous inner and outer edges of the parametric light fixture shade. The continuous sidewall of the lampshade projects downwardly from the parametric light fixture shade encircling the light fixture. The lampshade is preferably fashioned of light transmissive material, and is also preferably integrally formed. A photovoltaic cell is a power source for the light and is carried by the upper extremity of the light fixture. The photovoltaic cell projects through the opening bound by the continuous inner edge of the parametric flange being exposed therethrough.

Consistent with the foregoing summary of a preferred embodiment of the invention, and the ensuing detailed description, which are to be taken together, the invention also contemplates associated light assembly embodiments.

BRIEF DESCRIPTION OF THE DRAWINGS

Referring to the drawings:

FIG. 1 is a top perspective view of a lampshade constructed and arranged in accordance with the principle of the invention;

FIG. 2 is a front elevational view of the lampshade of FIG. 2, the rear elevational view, the left side elevational view, and the right side elevational view being substantially identical thereof

DETAILED DESCRIPTION OF PREFERRED EMBODIMENTS

Figure 6:
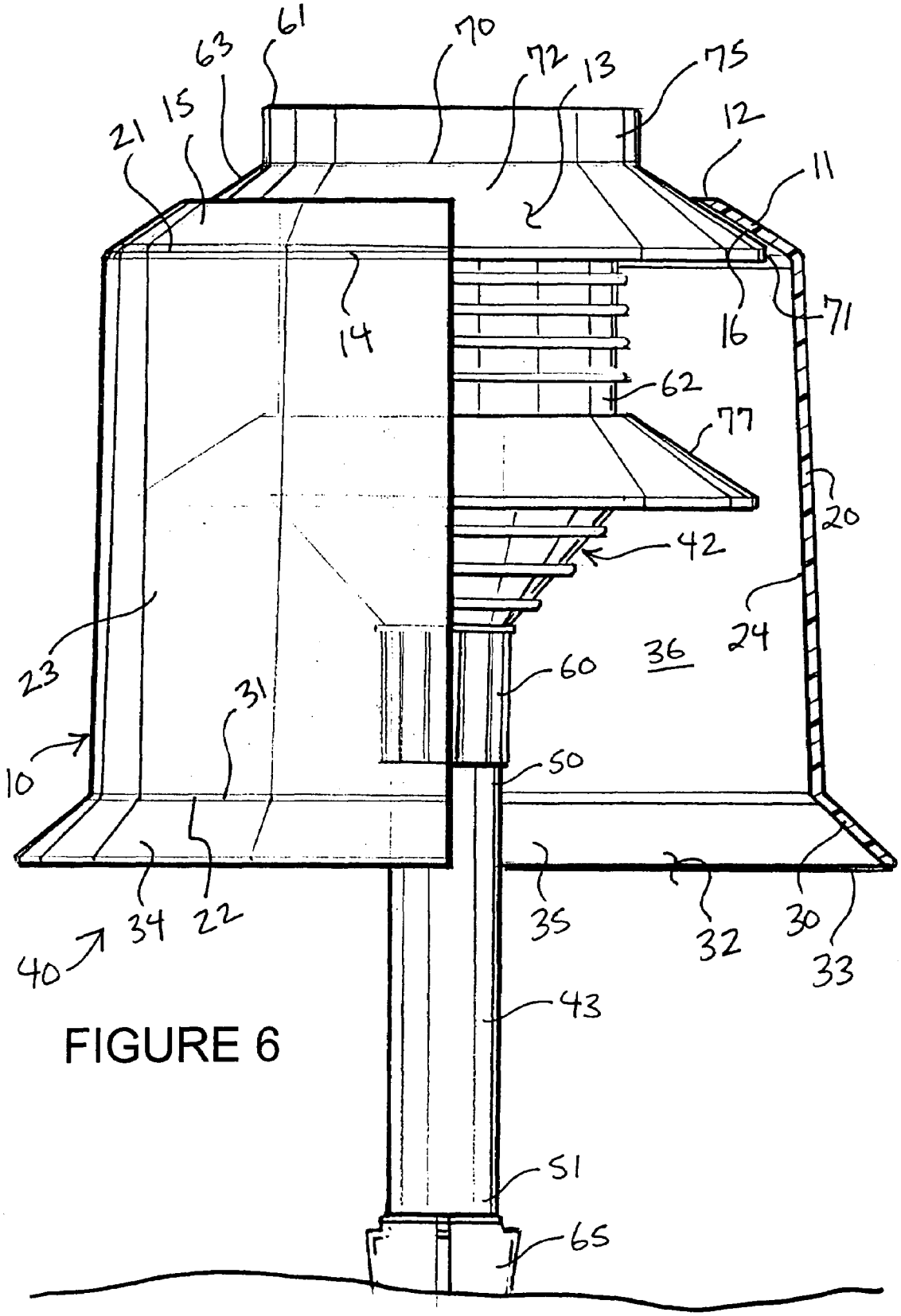
FIG. 6 is an enlarged side elevational view of one of the light assemblies of FIG. 5, with portions of the lampshade attached thereto being broken away for illustrative purposes.

Turning now to the drawings, in which like reference characters indicate corresponding elements throughout the several views, attention is first directed to FIGS. 1 and 6 in which there is seen a lampshade 10 including a parametric flange 11 having a continuous inner edge 12 bounding an opening 13 and an opposing continuous outer edge 14, a continuous outer face 15 and an opposing continuous inner face 16. A continuous sidewall 20 is attached to and depends from parametric flange 11, and includes a continuous upper edge 21 affixed to continuous outer edge 14 and an opposing continuous lower edge 22, a continuous outer face 23 and an opposing continuous inner face 24.

Lampshade 10 also includes another parametric flange designated at 30, which has a continuous inner edge 31, an opposing continuous outer edge 33 bounding an opening 32, a continuous outer face 34, and an opposing continuous inner face 35 (FIG. 6). Continuous inner edge 31 is affixed to continuous lower edge 22. Parametric flange 11 is considered an upper parametric flange of lampshade 10, and parametric flange 30 is considered a lower parametric flange of lampshade 10. Also, opening 13 is considered an upper opening of lampshade, and opening 32 is considered a lower opening of lampshade 10. Openings 13 and 32 each lead into a chamber 36 bound and defined by continuous inner face 24 of sidewall 20. Furthermore, flange 11 constitutes the upper end of lampshade 10, and flange 30 constitutes the lower end of lampshade 10. Lampshade 10 is fashioned of relatively thin material being preferably made of a light transmissive material or combination of materials, such as light transmissive plastic, polyethylene, or the like, which allows light to pass therethrough. Lampshade 10 is preferably integrally formed, such as by molding, by machining lampshade 10 from a workpiece, or other suitable technique providing integral formation of lampshade 10. However, it can be formed as a plurality of attached parts, if desired, or in other ways.

Figure 3:
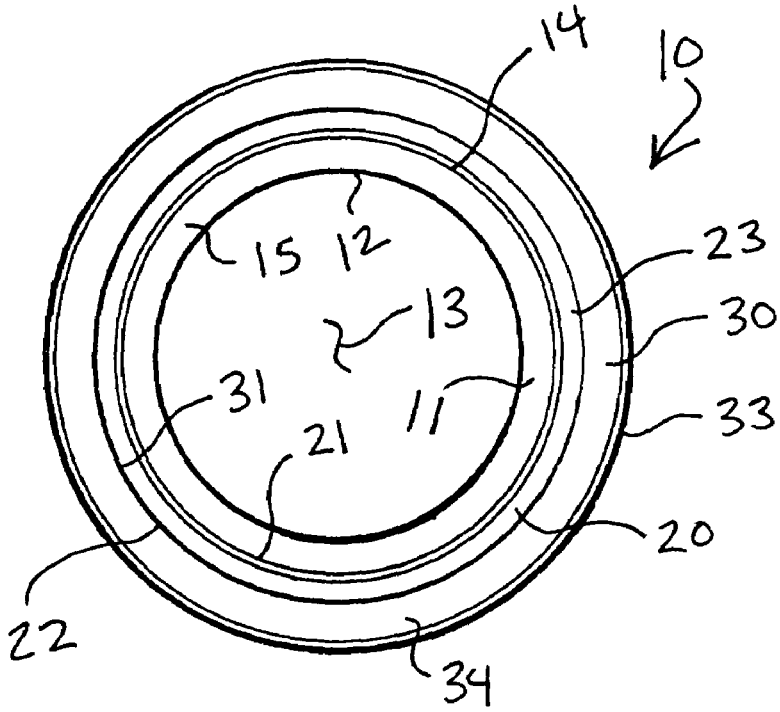
FIG. 3 is a top plan view of the lampshade of FIG. 1.
Figure 4:
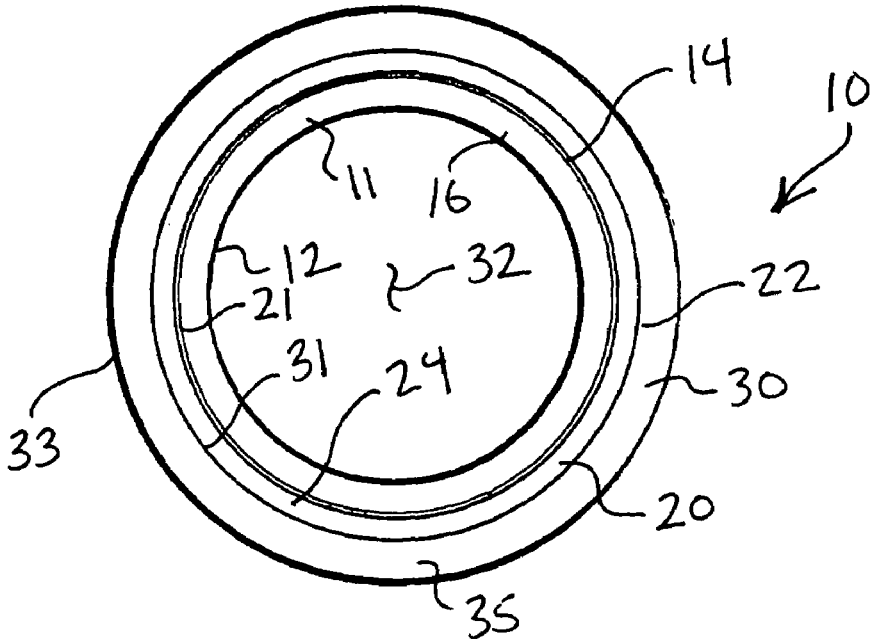
FIG. 4 is a bottom elevational view of the lampshade of FIG. 1.

As best seen in FIG. 6, parametric flange 10 projects inwardly from continuous upper edge 21 of continuous sidewall 20, and is angled upwardly relative to continuous upper edge 21. Parametric flange 30 projects outwardly from continuous lower edge 22 of continuous sidewall 20, and is angled downwardly relative to continuous lower edge 22. As a matter of disclosure, it is to be understood that FIG. 1 is a top perspective view of lampshade 10, and FIG. 2 is a front elevational view of lampshade 10, the rear elevational view, the left side elevational view, and the right side elevational view being substantially identical thereof. Also, FIG. 3 is a top plan view of lampshade 10, and FIG. 4 is a bottom plan view of lampshade 10.

Figure 5:
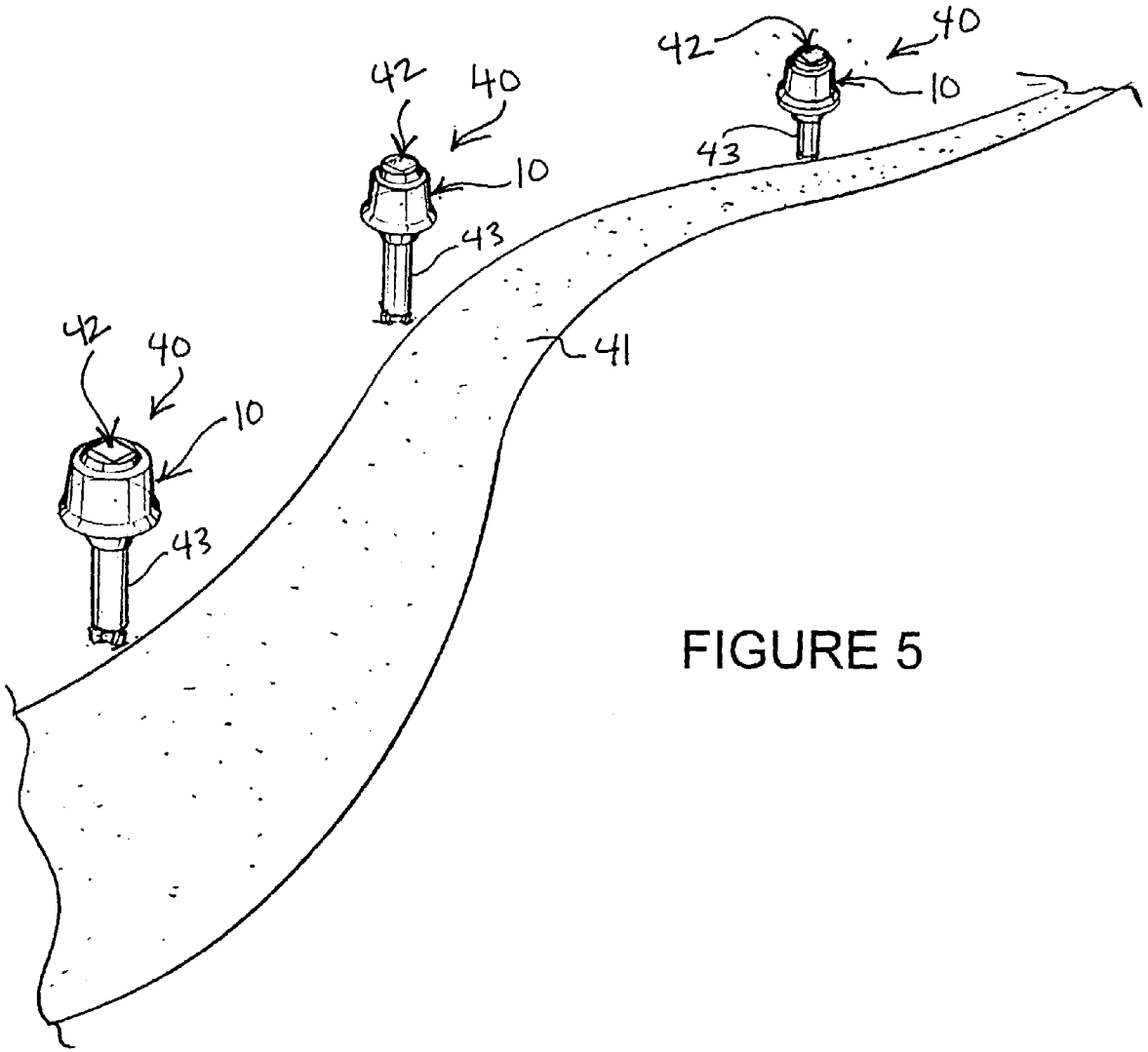
FIG. 5 is a perspective view of a plurality of light assemblies installed at spaced intervals along a walkway, each of the light assemblies including a light fixture having the lampshade of FIG. 1 coupled thereto in accordance with the principle of the invention.

Reference is now made to FIG. 5, which is a perspective view of a plurality of light assemblies installed at spaced intervals along a walkway 41, each of the light assemblies being denoted at 40 and including a combination of a light fixture 42 and lampshade 10 coupled thereto, in accordance with the principle of the invention. Light fixtures 42 are each mounted to an elongate support 43 embedded into and projecting upwardly from the ground. Walkway 41 is located outside, and assemblies 40 are disposed at spaced intervals alongside walkway 41 being exemplary of outdoor landscape lighting, which is the preferred environment for the implementation of lampshade 10. Assemblies 40 are identical in structure, one of which will now be discussed in conjunction with FIGS. 6–8 with the understanding that the ensuing discussion of one of assemblies 40 applies to each of assemblies 40.

Referring to FIG. 6, elongate support 43 has an upper end 50 and an opposing lower end 51, and is fashioned of plastic, polyethylene, aluminum, wood, or other suitably rigid material or combination of materials. Light fixture 41 has a lower extremity 60 affixed to upper end 50 of elongate support 43 and an opposing upper extremity 61. Light fixture 42 also includes a light 62 positioned between upper and lower extremities 61 and 60, and a parametric light fixture shade 63 disposed at upper extremity 61 overlying light 62. Lower end 51 of elongate support 43 incorporates an attached stake 65, which is to be forcibly inserted into the ground for supporting assembly 40 in an upright condition as shown in FIGS. 5 and 6.

Figure 7:
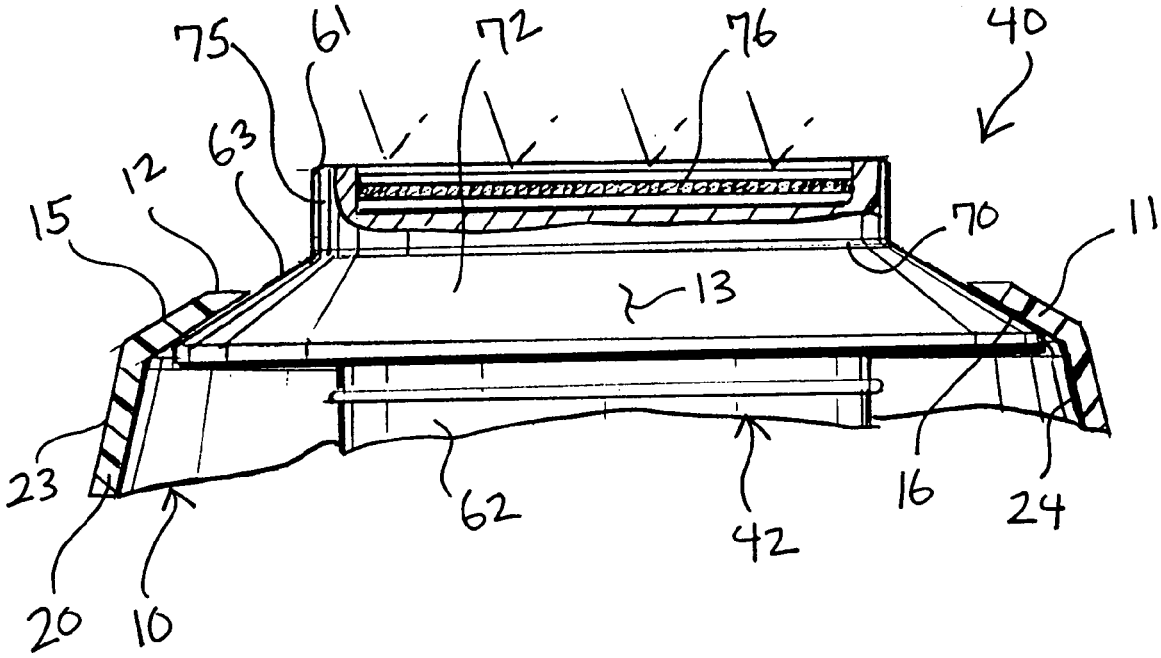
FIG. 7 is an enlarged, fragmented, vertical sectional view of one of the light fixtures depicted in FIG. 5.
Figure 8:
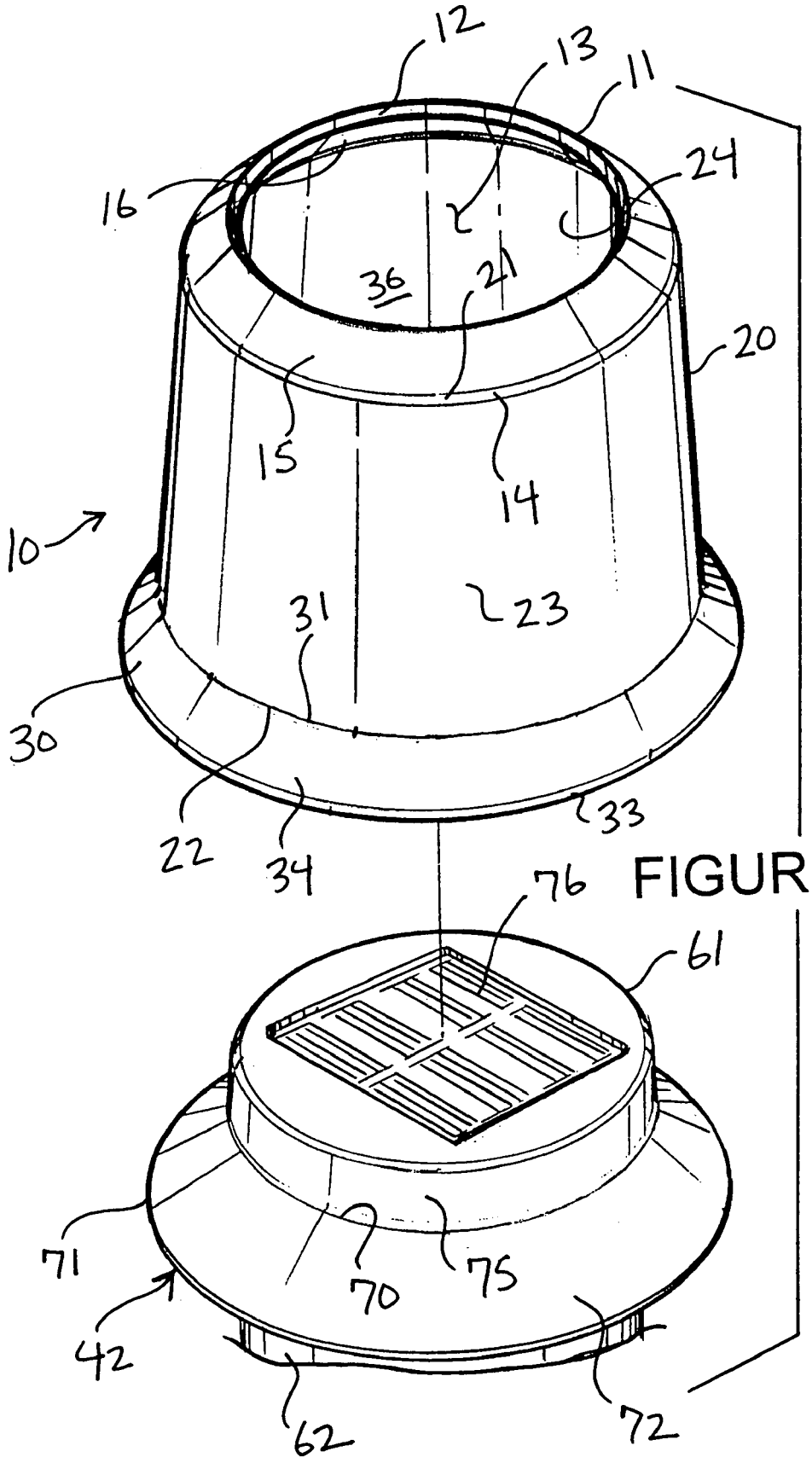
FIG. 8 is an enlarged exploded perspective view of one of the light installations of FIG. 5 including the lampshade and a fragmented portion of the light fixture.

Parametric light fixture shade 63 is fashioned of plastic, polyethylene, or other like material or combination of materials, and includes a continuous inner 70 edge and an opposing continuous outer edge 71, an upper/outer parametric face 72 between edges 70 and 71, and an opposing lower/outer face facing light 62. Shade 63 incorporates a central support fixture 75, which is attached to and encircled by inner edge 70. Referring momentarily to FIG. 7, support fixture 75 houses a photovoltaic cell 76, which converts sunlight into electrical power, which is coupled electrically to light 62 in a conventional manner, and which is the power source for light 62. As seen in FIG. 8, photovoltaic cell 76 is not only mounted to and held by support fixture 75, but is also left exposed allowing it to be exposed to sunlight. Light fixture 42 also incorporates an intermediate parametric shade 77 encircling light 62 and which is positioned between parametric light fixture shade 63 and lower extremity 60. The combination of elongate support 43 and light fixture 42, including photovoltaic cell, is well known in the art, further details of which will readily occur to the skilled artisan and will not be further discussed.

According to the principle of the invention, lampshade is mounted onto and supported by light fixture 42 forming assembly 40. Light fixture 42 and lampshade 10 are sized and shaped to fit together as will now be presently described. As seen in FIG. 6, Continuous inner face of parametric flange 11 of lampshade 10 rests against upper parametric face 72 of parametric light fixture shade 63, and continuous inner edge 12 of parametric flange 11 is positioned between continuous inner and outer edges 70 and 71 of parametric light fixture shade 63. Continuous sidewall 20 of lampshade 10 projects downwardly from parametric light fixture shade 63 encircling light fixture 42, and engulfing light fixture 42 substantially from continuous outer edge 71 of parametric light fixture shade 63 and lower extremity 60 of light fixture 42. As seen in FIG. 7, fixture 75 extends upwardly through opening 13 bound by continuous inner edge 12 leaving photovoltaic cell 76 exposed to sunlight, in accordance with the principle of the invention.

Lampshade 10 is typically installed after light fixture 42 is installed into place by forcibly inserting stake 56 (FIG. 6) into the ground so as to position light fixture 42 in an upright and elevated position relative to the ground. To install lampshade 10 onto light fixture 42, and with reference to FIG. 8, lampshade 10 is taken up, such as by hand, and its lower end is directed toward upper extremity 61 of light fixture 42. Lampshade 10 is maneuvered downwardly toward upper extremity 61 passing upper extremity 61 into and through opening 32 (FIG. 6) and into chamber 36. Continued downward movement of lampshade 10 is made passing light fixture 42 into chamber 36 and fixture 75 into and through opening 13 and bringing continuous inner face 16 into engagement against upper parametric face 72, which completes the installation of lampshade 10. To remove lampshade 10 from light fixture 42, the foregoing operation need only be reversed.

Installation of lampshade 10 with light fixture 42 is desirable because it substantially engulfs light fixture 42 from outer edge 71 of parametric light fixture shade 63 thus altering the overall appearance of light fixture 42. Also, lampshade 10 may be fashioned of different colors and may have applied thereto decorative indicia for providing a pleasing decorative effect. The decorative indicia, which may be applied by etching, embedding, imprinting, by adhesive application, etc., may include, flowers, balloons, indicia indicative of fireworks, indicia indicative of a secular holiday, such as Easter or Christmas, indicia indicative of a non-secular holiday, such as Thanksgiving, Halloween, etc. In this way, consumers may purchase differently decorated lampshades constructed and arranged in accordance with the principle of the invention and the use them as desired with their outdoor lighting fixtures as herein described for providing a desired decorative effect. Because lampshade 10 is fashioned of a light transmissive material or a combination of light transmissive materials, decorative indicia applied to lampshade 10 is illuminated by light 62 providing a desired decorative effect. Furthermore, the provision of opening 13 at the upper end of lampshade 10 is important because it allows fixture 75 to extend therethrough leaving photovoltaic cell 76 unobstructed by lampshade 10 and exposed to sunlight. Although lampshade 10 is particularly exemplary for use with solar-powered lights as herein described, it can be employed equally well with light fixtures powered in other ways, such as by way of conventional electrical wiring or one or more batteries.

Light fixture 42 is generally round in shape, and lampshade 10 has a complementing generally rounded shape for providing a suitable fit of lampshade 10 to light fixture 42. Consistent with the teachings provided herein and the structural relationship between the structural components of lampshade 10 and the structural components of light fixture 42, lampshade 10 may be fashioned of other shapes as can light fixture 42, such as triangular, square, oval, etc. Furthermore, although a stake 56 is used to secure elongate support 43 in the ground, elongate support 43 may be fixed in place in other ways commensurate with known installation techniques routinely employed for installing outdoor light fixtures.

The invention has been described above with reference to a preferred embodiment. However, those skilled in the art will recognize that changes and modifications may be made to the embodiment without departing from the nature and scope of the invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same,

The invention claimed is:

1. A light assembly, comprising:

an elongate support having an upper end and an opposing lower end;

a light fixture having:

a lower extremity affixed to the upper end of the elongate support and an opposing upper extremity, a light between the upper and lower extremities, and a parametric light fixture shade disposed at the upper extremity and overlying the light, the parametric light fixture shade including a continuous inner edge and an opposing continuous outer edge, and an upper parametric face between the continuous inner and outer edges;

a lampshade comprising:

a parametric flange having a continuous inner edge bounding an opening and an opposing continuous outer edge, a continuous outer face and an opposing continuous inner face, a continuous sidewall depending from the parametric flange and having a continuous upper edge affixed to the continuous outer edge of the parametric flange and an opposing continuous lower edge, a continuous outer face and an opposing continuous inner face;

the continuous inner face of the parametric flange of the lampshade resting against the upper parametric face of the parametric light fixture shade, and the continuous inner edge of the parametric flanged positioned between continuous inner and outer edges of the parametric light fixture shade; and the continuous sidewall of the lampshade projecting downwardly from the parametric light fixture shade encircling the light fixture.

2. The light assembly according to claim 1, wherein the lampshade is fashioned of light transmissive material.

3. The light assembly according to claim 1, wherein the lampshade is integrally formed.

4. The light assembly according to claim 1, further including a photovoltaic cell coupled electrically to the light and attached to the upper extremity of the light fixture.

5. A light assembly, comprising:

an elongate support having an upper end and an opposing lower end;

a light fixture having:

a lower extremity affixed to the upper end of the elongate support and an opposing upper extremity, a light between the upper and lower extremities, and a parametric light fixture shade disposed at the upper extremity and overlying the light, the parametric light fixture shade including a continuous inner edge and an opposing continuous outer edge, and an upper parametric face between the continuous inner and outer edges;

a lampshade comprising:

a parametric flange having a continuous inner edge bounding an opening and an opposing continuous outer edge, a continuous outer face and an opposing continuous inner face, a continuous sidewall depending from the parametric flange and having a continuous upper edge affixed to the continuous outer edge of the parametric flange and an opposing continuous lower edge, a continuous outer face and an opposing continuous inner face;

the continuous inner face of the parametric flange of the lampshade resting against the upper parametric face of the parametric light fixture shade, and the continuous inner edge of the parametric flanged positioned between continuous inner and outer edges of the parametric light fixture shade; and the continuous sidewall of the lampshade projecting downwardly from the parametric light fixture shade encircling and engulfing the light fixture substantially from the continuous outer edge of the parametric light fixture shade and the lower extremity of the light fixture.

6. The light assembly according to claim 5, wherein the lampshade is fashioned of light transmissive material.

7. The light assembly according to claim 5, wherein the lampshade is integrally formed.

8. The light assembly according to claim 5, further including a photovoltaic cell coupled electrically to the light and attached to the upper extremity of the light fixture.

9. A light assembly, comprising:

an elongate support having an upper end and an opposing lower end;

a light fixture having:

a lower extremity affixed to the upper end of the elongate support and an opposing upper extremity, a light between the upper and lower extremities, and a parametric light fixture shade disposed at the upper extremity and overlying the light, the parametric light fixture shade including a continuous inner edge and an opposing continuous outer edge, and an upper parametric face between the continuous inner and outer edges, a photovoltaic cell attached to the upper extremity of the light fixture comprising a power source for the light;

a lampshade comprising:

a parametric flange having a continuous inner edge bounding an opening and an opposing continuous outer edge, a continuous outer face and an opposing continuous inner face, a continuous sidewall depending from the parametric flange and having a continuous upper edge affixed to the continuous outer edge of the parametric flange and an opposing continuous lower edge, a continuous outer face and an opposing continuous inner face;

the continuous inner face of the parametric flange of the lampshade resting against the upper parametric face of the parametric light fixture shade, and the continuous inner edge of the parametric flanged positioned between continuous inner and outer edges of the parametric light fixture shade; and the continuous sidewall of the lampshade projecting downwardly from the parametric light fixture shade encircling the light fixture;

wherein the photovoltaic cell projects through the opening bound by the continuous inner edge of the parametric flange being exposed therethrough.

10. The light assembly according to claim 9, wherein the lampshade is fashioned of light transmissive material.

11. The light assembly according to claim 9, wherein the lampshade is integrally formed.

12. The light assembly according to claim 9, further comprising the continuous sidewall of the lampshade engulfing the light fixture substantially from the continuous outer edge of the parametric light fixture shade and the lower extremity of the light fixture.

* * * * *